United States Patent [19]

Nicolay et al.

[11] 3,935,826

[45] Feb. 3, 1976

[54] METHOD OF AND APPARATUS FOR FEEDING A WORKPIECE ALONG A SURFACE OF A SEWING MACHINE

[75] Inventors: Karl Nicolay, Bielefeld; Ernst V. D. Osten-Sacken, Brackwede, both of Germany

[73] Assignee: Durkoppwerke GmbH, Bielefeld, Germany

[22] Filed: July 2, 1974

[21] Appl. No.: 485,293

[30] Foreign Application Priority Data

July 26, 1973 Germany ..... 2337966

[52] U.S. Cl. ..... 112/212

[51] Int. Cl.[2] ..... D05B 27/04

[58] Field of Search ..... 112/203, 206, 207, 212, 112/213

[56] References Cited

UNITED STATES PATENTS

| | | | |
|---|---|---|---|
| 3,191,561 | 6/1965 | Nicolay | 112/212 |
| 3,196,815 | 7/1965 | von Hagen | 112/207 |
| 3,583,344 | 6/1971 | Meier et al. | 112/212 |
| 3,828,704 | 8/1974 | von Hagen | 112/212 |

*Primary Examiner*—George H. Krizmanich
*Attorney, Agent, or Firm*—Karl F. Ross; Herbert Dubno

[57] ABSTRACT

A workpiece is held down against a support surface by a holddown foot. Then a feed foot is brought into engagement with this workpiece with its displacement speed decreasing continuously and uniformly until the feed foot comes to a stop against the workpiece, pressing it against the support surface. Thereafter the holddown foot is raised away from the workpiece and the feed foot slides the workpiece a predetermined distance along the surface toward the sewing station. The holddown foot then is brought into engagement with the workpiece on the surface, again with its speed decreasing uniformly and continuously until it comes to a stop on the workpiece. The feedfoot is lifted away from the workpiece and brought back into a position to advance it again. Each of these feet is carried on a rod pivoted of a ternary link guided on a frame and having its remaining pivot connected via a rigid lever also pivoted on the frame and oscillated back and forth by an eccentric arrangement operated by the drive shaft of the sewing machine.

11 Claims, 6 Drawing Figures

METHOD OF AND APPARATUS FOR FEEDING A WORKPIECE ALONG A SURFACE OF A SEWING MACHINE

FIELD OF THE INVENTION

The present invention relates to a method of and an apparatus for feeding a workpiece to the sewing station of a sewing machine. More particularly this invention concerns such a feed arrangement wherein the work is advanced by a feed foot and is maintained in place on the surface of the sewing machine by a holddown foot as the feed foot is brought back to its starting position before each workpiece advance.

BACKGROUND OF THE INVENTION

There is known a workpiece feed for a sewing machine comprising a pair of feet both of which are reciprocal toward and away from a support surface and one of which, the feed foot, is also slidable along the support surface so as incremently to advance the workpiece toward the sewing station on the support surface. Each of the feet is connected via a respective rod to a respective pivot of a ternary link whose other pivot is connected to a crank driven by the drive shaft of the sewing machine so that the ternary link is displaced toggle-fashion between a pair of overcenter positions in each of which a respective one of the feet is pressed against the workpiece and the surface. Such a system has the considerable disadvantage that the feet are displaced with relatively high speed against the workpiece, so it is necessary to provide a certain amount of lost motion in the system such that the two feet will both simultaneously engage the workpiece for a brief instant before each one is lifted. Thus the displacement speed of the feet is at a maximum just at that instant when the feet engage the workpiece and press it against the surface.

Such a system has the considerable disadvantage that the feet pound against the workpiece and frequently damage it. In addition the sewing machine so equipped creates a considerable amount of noise and vibration and goes out of adjustment quickly. In addition due to the violence with which the feet strike the fabric workpiece they frequently bounce up briefly and allow this workpiece to move on the support surface out of alignment with its desired position. Thus it is necessary to provide rather complicated and expensive damping arrangements to prevent the reciprocating feet from damaging the workpiece and vibrationally damaging the machine. Of course it is also possible to simply operate the sewing machine at slower speed so as to avoid these difficulties, however this considerably cuts production efficiency and therefore is undesirable.

OBJECTS OF THE INVENTION

It is therefore an object of the present invention to provide an improved method of operating a sewing machine feed having a reciprocal holddown foot and a reciprocal feed foot.

Another object of this invention is an improved apparatus for feeding a workpiece along a surface to a sewing station.

Yet another object is to provide an improved method of and apparatus for feeding a workpiece to a sewing machine which is simple and which does not damage the workpiece.

SUMMARY OF THE INVENTION

These objects are attained according to the present invention in an arrangement wherein the feed foot at least is displaced toward the workpiece on the surface with an advance speed that decreases uniformly and continuously until the feed foot comes to a stop against the workpiece in a position pressing the workpiece against the surface. Thus it is possible to dispense with complicated damping arrangements, as the feed foot is brought gently into engagement with the workpiece while over most of its path of travel it moves at relatively high speed.

In accordance with further features of this invention the holddown foot is similarly reciprocated into and out of engagement with the workpiece alternately with the feed foot so that the workpiece is in no way damaged, yet a rapid operation of the machine is possible.

According to further features of this invention the holddown foot and the feed foot are both mounted via respective generally parallel rods connected to respective pivots of a ternary link whose remaining pivot is connected to a rigid lever pivoted on a frame which is limitedly displaceable only transversely to the feed surface. The lever is swung back and forth about its pivot by means of an eccentric carried on the drive shaft of the sewing machine.

According to yet another feature of this invention the frame is provided with a guide which receives the ternary link. Thus, this link is displaceable between two overcenter positions each corresponding to a condition of the apparatus wherein one of the feet presses the workpiece against the surface and the other foot is lifted from the surface, and an intermediate position wherein both of the feet press the workpiece against the surface.

According to yet another feature of the invention a coil spring is provided around each of the rods extending between one of the link pivots and the respective foot. This spring biases the respective foot downwardly tending to draw the ternary link into the intermediate position. In addition the frame is biased downwardly by another spring, this last-mentioned spring serving to establish the biasing force with which the feet press the workpiece against the surface.

DESCRIPTION OF THE DRAWING

The above and other objects, features and advantages of the invention will become more readily apparent from the following description, reference being made to the accompanying drawing, in which.

SPECIFIC DESCRIPTION

Figure 1:
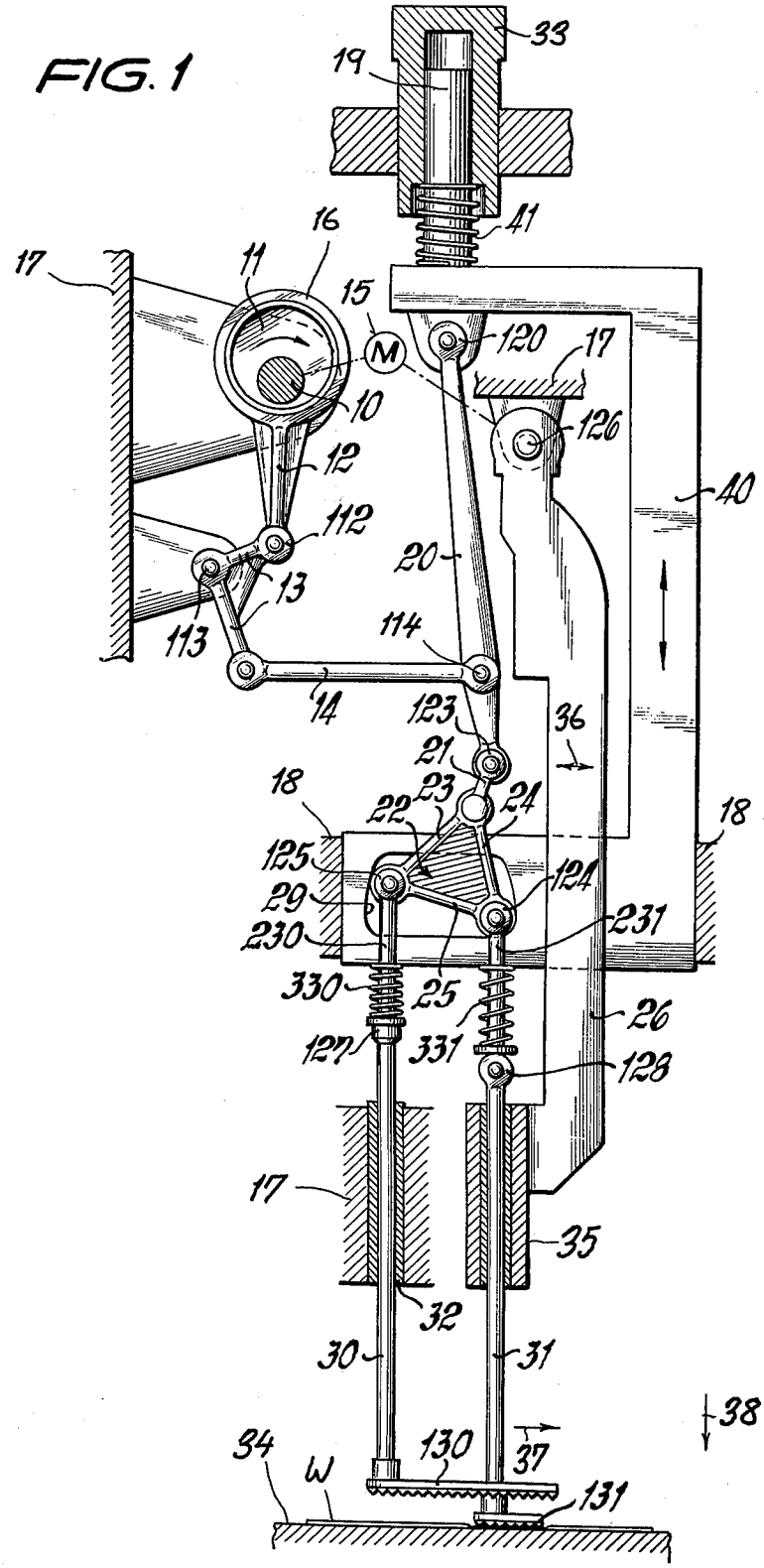
FIGS. 1—3 are side views partly in section illustrating the apparatus according to the present invention in three different positions.
Figure 2:
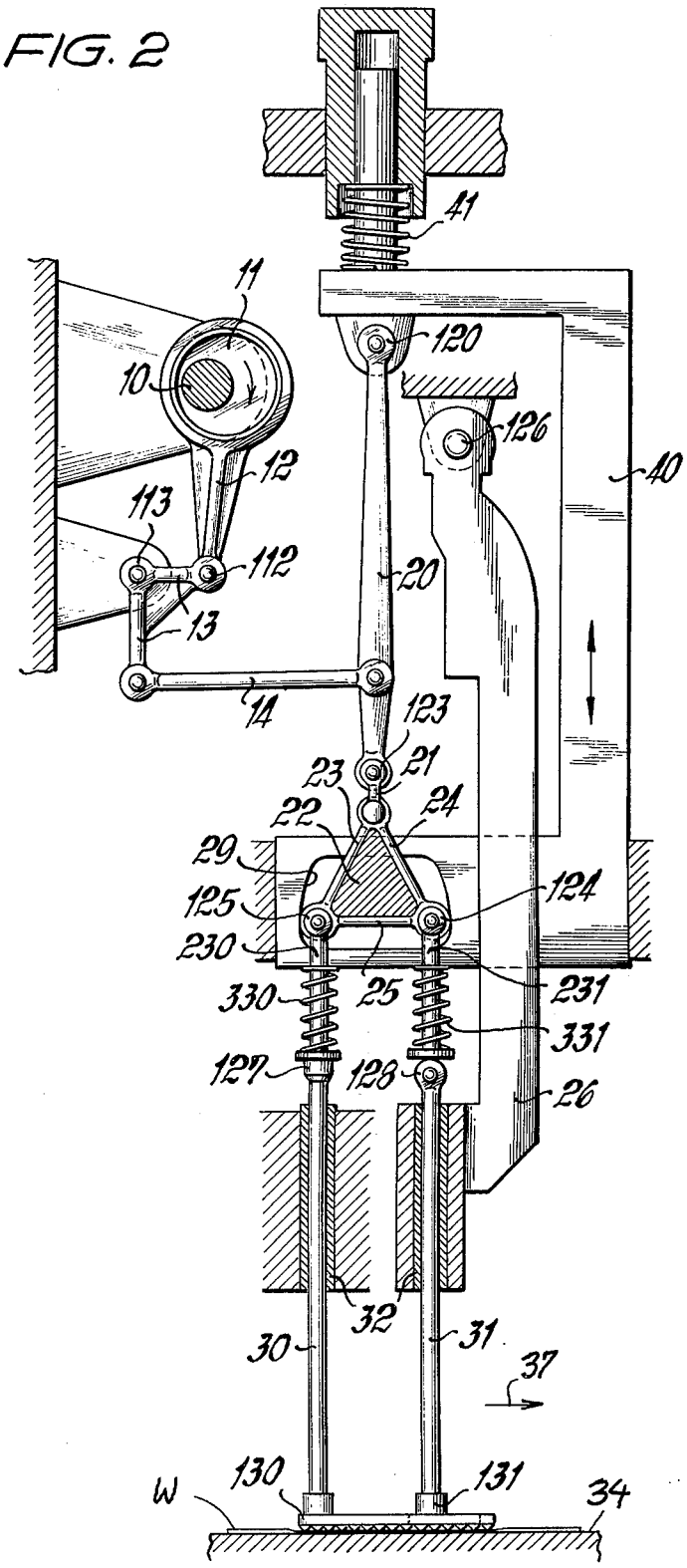
Figures 3, 6:
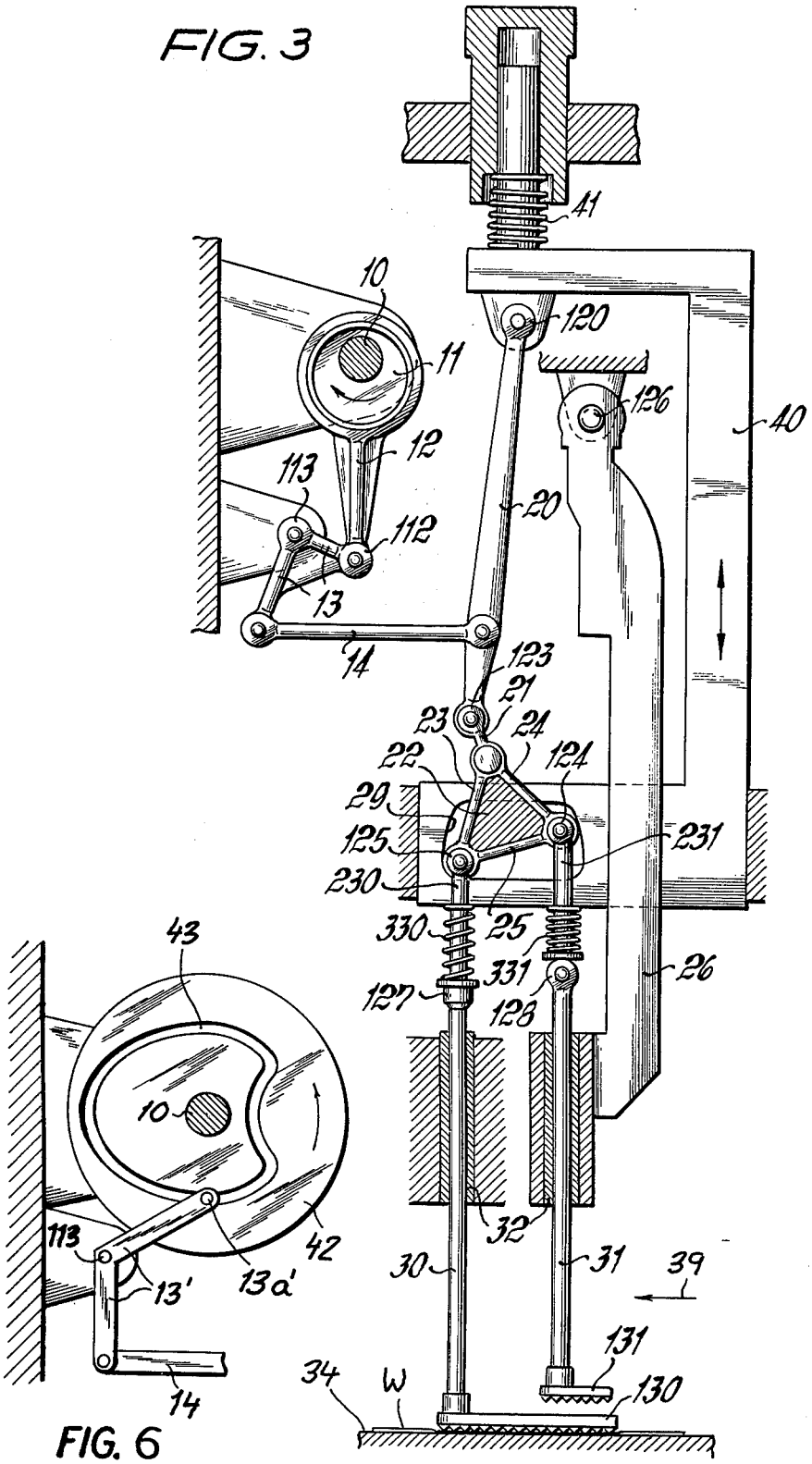
FIG. 6 is a detail view of another actuator according to the invention.

As shown in FIGS. 1–3 a sewing machine has a drive shaft 10 continuously rotated by a motor 15 and rotationally connected to an eccentric disk 11 received in a ring 16 provided with an arm 12. As the shaft 10 rotates the pivot 112 at the end of arm 12 will therefore be displaced vertically.

A ternary link, here a rocker 13, is pivoted on the housing 17 of the sewing machine at a pivot 113 extending parallel to the shaft 10 and is connected to the pivot 112 of the crank 12. The other arm of the rocker 13 is connected to one end of a binary link 14 whose other end is pivoted at 114 between the ends of a lever 20 pivoted at its upper end at 120 on a frame 40 which is vertically displaceable in guides 18 in the frame 17. At its upper end the frame 40 is provided with upwardly extending pin 19 received in a cylindrical sleeve 33 carried on housing 17. A spring 41 is braced between the sleeve 33 and the top of the frame 40 and serves to bias this frame 40 downwardly as shown in FIGS. 1–3.

The lower end of the lever 20 is connected at a pivot 123 to a ternary link 22 whose triangular central region is hatched in FIGS. 1–3. This link 22 has three side members 23, 24, and 25 defining the hatched triangle and meeting at lower pivots 124 and 125. At the upper apex of the triangular link 22 there is provided a short extension 21 which terminates at the pivot 123.

The ternary link 23 is received and guided within a guide hole 29 formed within the lower section of the U-shaped frame 40.

A holddown foot 130 and a feed foot 131 are each mounted on respective rods 30 and 31 and are engageable with a support surface 34 of the sewing machine. The rod 31 is guided in a sleeve 35 formed at the lower end of a bar 26 pivoted at 126 on the housing 17 and connected to the motor 15 so as to oscillate back and forth as shown by the double-headed arrow 36. A pivot or swivel 128 is provided at the upper end of the rod 31 and another short rod section 231 extends between this pivot 128 and the pivot 124. A coil spring 331 surrounds the rod 231 and serves to bias the foot 131 downwardly.

The rod 30 is received in a guide 32 on the housing 17 and is formed with a shoulder 127. An upper section 230 of the rod 30 is surrounded by a respective coil spring 330 which serves to bias the foot 130 also down toward the support surface 34. This upper section 230 is pivoted at 125 on the link 22.

The apparatus according to the invention functions as follows:

To start with, as shown in FIG. 1 the feed foot 131 is engaged against a workpiece W on the surface 34 and is advanced as shown by arrow 37 toward a sewing station 38. In this position pivot 124 of the link 122 is resting against the bottom of the guide cutout 129 and the other link 125 is lifted. The lever 20 is to the right as shown in FIG. 1 and the pivots 120, 114 and 124 are arranged in an over center position.

Thereafter continued rotation of the shaft 10 through 90° serves to pull the lever 20 back to a vertical intermediate position as shown in FIG. 2. In this position both pivots 124 and 125 rest on the bottom of the cutout 29. At the same time both feet 130 and 131 rest on the workpiece W holding it stationarily on the surface 34. In this position the foot 131 is not advanced.

Thereafter as shown in FIG. 3, on rotation of the shaft 10 through another 90°, the pivot 125 of the link 22 rests against the bottom of the guide 29 and the foot 131 is lifted from the surface 34 whereas the foot 130 presses down against this surface 34. When the apparatus is in this position the foot 131 is moved backwardly as shown by arrow 39 so as to allow it to again resume its starting position in order to be able to push the workpiece W forward in the direction of arrow 37.

Figure 4:
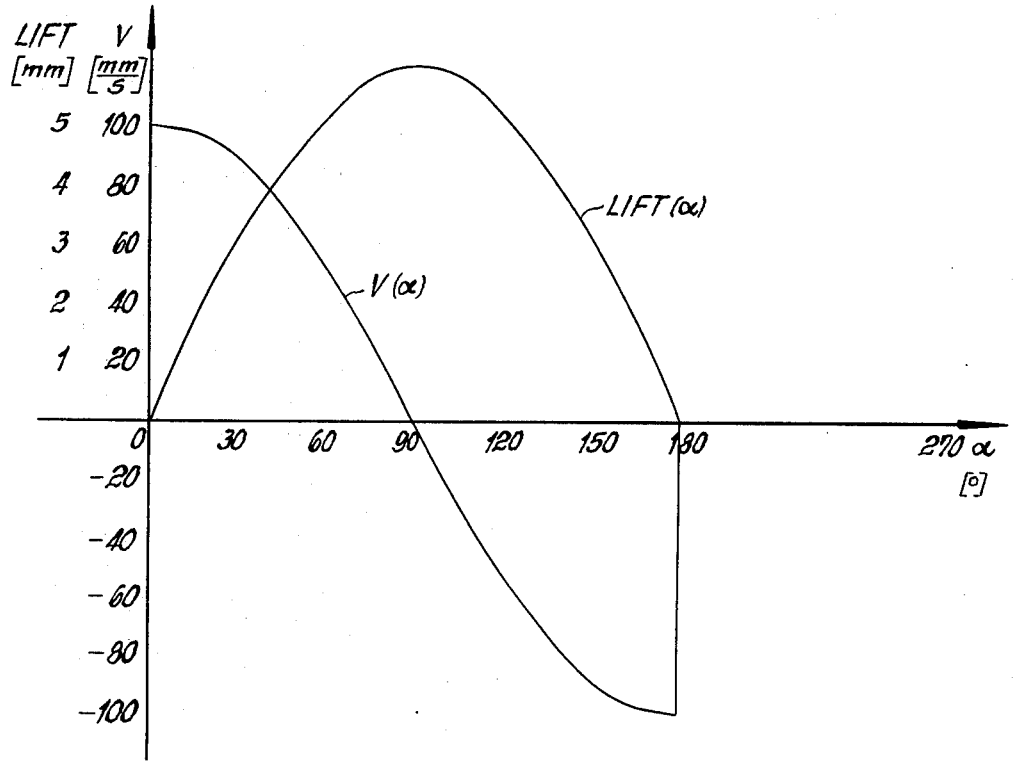
FIGS. 4 and 5 are diagrams illustrating the relationship between dispension of speed and displacement in prior art systems and the system according to the present invention, respectively.
Figure 5:
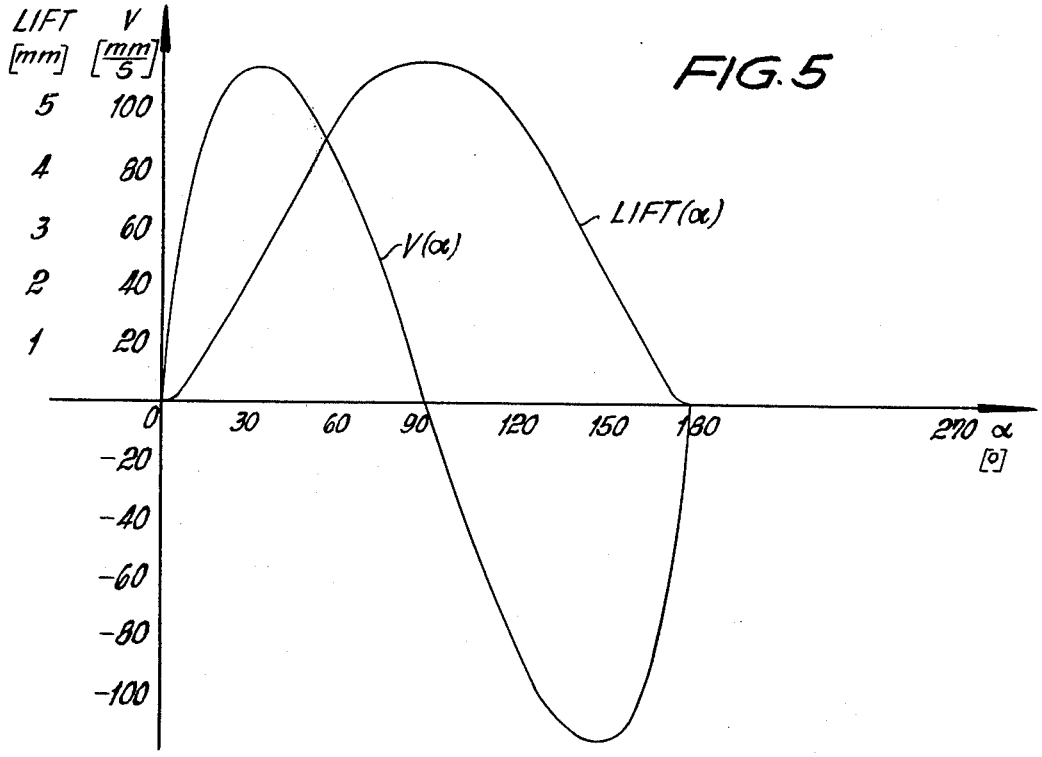

FIGS. 4 and 5 contrast the functioning of the prior-art system and the system according to the present invention. FIG. 4 shows how, with the prior-art system, when either of the feet was in its zero or lowest position it was also moving at maximum speed so that it was brought rapidly to a halt on striking the workpiece and therefore was liable to damage the workpiece and cause considerable vibration in the apparatus.

The diagram of FIG. 5 is contrasted to this in that it indicates how, as the feet are moved to their bottom position, that is the position wherein they press the workpiece W against the surface 34, they are moved with uniformity and continuously decreasing speed. For all intents and purposes the workpiece is brought uniformly and continuously to a halt just as it comes into engagement with the workpiece W. A small amount of play provided by the spring 41 insures that the workpiece W is held firmly against the surface 34 but prevents any damage to the workpiece W.

FIG. 6 shows a cam 42 formed with a heart-shaped cam groove 43 mounted on the shaft 10. A follower 13*a*′ carried on a rocker 13′ is received in the shaft. This rocker 13′ operates the link 14 in the manner described above with reference to FIG. 5, the line 14 being in FIG. 2 position.

I claim:

1. A method of operating a sewing-machine feed having a reciprocal holddown foot and a reciprocable feed foot, said method comprising the steps of:

a. pressing a workpiece web against a support surface with said holddown foot;

b. thereafter displacing said feed foot toward said workpiece at a speed first increasing to a maximum and then decreasing uniformly and continuously from said maximum until said feed foot comes to a stop against said workpiece pressing same against said surface, the uniform and continuous speed decrease bringing said feed foot to zero speed upon the pressing of said workpiece thereby;

c. thereafter displacing said holdown foot away from said workpiece;

d. thereafter sliding said feed foot and said workpiece along said surface;

e. thereafter displacing said holddown foot toward said workpiece at a speed first increasing to a maximum and then decreasing uniformly and continuously from its maximum until said holddown foot comes to a stop against said workpiece in a position pressing same against said surface, the uniform and continuous speed decrease bringing said holddown foot to zero speed upon the pressing of said workpiece thereby;

f. repeating steps (b) to (e) sequentially to incrementally advance said workpiece across said surface.

2. An apparatus for feeding a workpiece along a surface to a sewing station, said apparatus comprising:

a holddown foot and a feed foot reciprocal toward and away from said surface;

means for periodically displacing said feed foot along said surface to advance said workpiece toward said station; and drive means connected to said feet for alternately advancing same toward said surface with an advance speed increasing during a first phase to a maximum and thereafter decreasing uniformly and continuously until each of said feet comes to a stop atop said workpiece in a position pressing same against said surface and for alternately displacing said feet away from said surface, said drive means being constructed and arranged so that the continuous and uniform decrease of the speed of each foot brings the same to zero speed simultaneously with the pressing of the foot against the workpiece.

3. The apparatus defined in claim 2 wherein said drive means includes a frame limitedly displaceable only toward and away from said surface and a kinematic linkage at least partially pivoted on said frame.

4. The apparatus defined in claim 3 wherein said sewing station constitutes part of a sewing machine having a driven shaft, said drive means including an eccentric on said shaft linked to said linkage.

5. The apparatus defined in claim 4 wherein said linkage includes a rigid lever pivoted at one end on said frame and operatively connected to said eccentric such that said lever oscillates back and forth pivotally as said shaft rotates.

6. The apparatus defined in claim 5 wherein said linkage includes a guide on said frame and a ternary link received in said guide and having a first pivot connected to the other end of said lever and second and third pivots operatively connected to said holddown foot and said feed foot, respectively.

7. The apparatus defined in claim 6 wherein said linkage further comprises a holddown rod extending between said second pivot and said holddown foot and a feed rod extending between said third pivot and said feed foot, and a pair of springs each braced between a respective rod and said frame end urging said feet toward said surface.

8. The apparatus defined in claim 7 wherein said frame is provided with a spring urging same downwardly toward said surface with a predetermined force.

9. The apparatus defined in claim 8 wherein said feed rod is provided with a swivel permitting sliding of said feed foot along said surface.

10. The apparatus defined in claim 9 wherein said pivots of said ternary link define an isosceles triangle, said drive means further comprising a bell crank having one end operatively connected to said eccentric and anotherr end operatively connected to said lever.

11. An apparatus for feeding a workpiece along a surface to a sewing station, said apparatus comprising:

a holddown foot and a feed foot reciprocal toward and away from said surface;

means for periodically displacing said feed foot along said surface to advance said workpiece toward said station; and drive means connected to said feet for alternately advancing same toward said surface with an advance speed decreasing uniformly and continuously until said feed comes to a stop atop said workpiece in a position pressing same against said surface and for alternately displacing said feet away from said surface, said drive means including a frame limitedly displaceable only toward and away from said surface and a kinematic linkage at least partially pivoted on said frame, said sewing station constituting part of a sewing machine having a driven shaft, said drive means including an eccentric on said shaft linked to said linkage, said linkage including a rigid lever pivoted at one end on said frame and operatively connected to said eccentric such that said lever oscillates back and forth pivotally as said shaft rotates, a guide on said frame and a ternary link received in said guide and having a first pivot connected to the other end of said lever and second and third pivots operatively connected to said holddown foot and said feed foot, respectively, and a holddown rod extending between said second pivot and said holddown foot and a feed rod extending between said third pivot and said feed foot, and a pair of springs each braced between a respective rod and said frame and urging said feet toward said surface, said frame being provided with a spring urging same downwardly toward said surface with a predetermined force, said feed rod being provided with a swivel permitting sliding of said feed foot along said surface, said pivots of said ternary link defining an isoceles triangle, said drive means further comprising a bell crank having one end operatively connected to said eccentric and another end operatively connected to said lever.

* * * * *